United States Patent [19]

Zaruba et al.

[11] Patent Number: 4,571,205

[45] Date of Patent: Feb. 18, 1986

[54] EXPRESS DELIVERY PLAYSET

[75] Inventors: John V. Zaruba, Chicago; Burton C. Meyer, Downers Grove; Steven P. Hanson, Winnetka, all of Ill.

[73] Assignee: Marvin Glass & Associates, Chicago, Ill.

[21] Appl. No.: 572,303

[22] Filed: Jan. 20, 1984

[51] Int. Cl.[4] ..... A63H 27/00; A63H 33/30; A63H 17/06; A63H 17/05

[52] U.S. Cl. ..... 446/230; 414/383; 414/495; 446/424; 446/428; 446/470; 446/491

[58] Field of Search ..... 446/3, 172, 174, 230, 446/424–428, 431, 465, 470; 244/137 R; 414/383, 495

[56] References Cited

U.S. PATENT DOCUMENTS

| | | | |
|---|---|---|---|
| 1,099,507 | 6/1914 | Marshall | 446/172 X |
| 1,894,950 | 1/1933 | Fitch | 414/383 |
| 2,463,397 | 3/1949 | Krebs | 446/172 |
| 2,973,604 | 3/1961 | Digirolamo et al. | 446/427 X |
| 3,769,743 | 11/1973 | Benkoe et al. | 446/3 |

*Primary Examiner*—F. Barry Shay

*Attorney, Agent, or Firm*—John S. Pacocha

[57] ABSTRACT

An express delivery playset includes an airplane, a delivery van, a loading dock, packages, a cargo transporter, and cargo containers. The plane has a conveyor belt for movement of the containers between a hatched opening at the fore end and the aft end of the substantially enclosed cargo area. Various packages carried by the van fit into the cargo containers and the plane, dock and transporter are adapted to receive the container. Off-loading packages from the van onto the dock is facilitated by a tilt-dump floor. A parallel linkage permits raising and lowering of the cargo transporter deck between the dock and the plane.

17 Claims, 14 Drawing Figures

EXPRESS DELIVERY PLAYSET

BACKGROUND OF THE INVENTION

1. Field of the Invention

This invention relates generally to playsets for children and more particularly to a playset with vehicles for handling cargo.

2. Background Art

Playsets that provide children with articles for emulating activities of the adult world have long been popular toys. For example, U.S. Pat. No. 3,868,177 discloses a camping set; U.S. Pat. No. 4,030,235 an animal hospital toy play kit; and U.S. Pat. No. 4,360,988 a toy assembly line for toy motor vehicles. Recently, the combination of air and land transportation for express or overnight delivery of packages has become a much publicized industry. Accordingly, there is a need for a playset that will enable children to emulate the handling of packages by simulated air and land transport in an entertaining and educational manner.

SUMMARY OF THE INVENTION

The present invention is concerned with providing a childrens playset that permits children to emulate the delivery of packages by combinations of air and land transport. These and other objects and advantages of the invention are achieved by a playset that includes an airplane, a delivery van, packages, a loading dock, a cargo transport and cargo containers. Packages of various sizes are delivered in the van which has a tilt-dump floor to off-load the packages onto the dock. The packages are then fitted into a cargo container which is carried on the cargo transport to the airplane. A parallel linkage permits changing the height of the transport deck to accommodate differences between the height of the dock and the airplane. Within the airplane, a conveyor belt is provided to move the cargo containers from the hatched opening at one end of the substantially enclosed cargo area to the other end.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
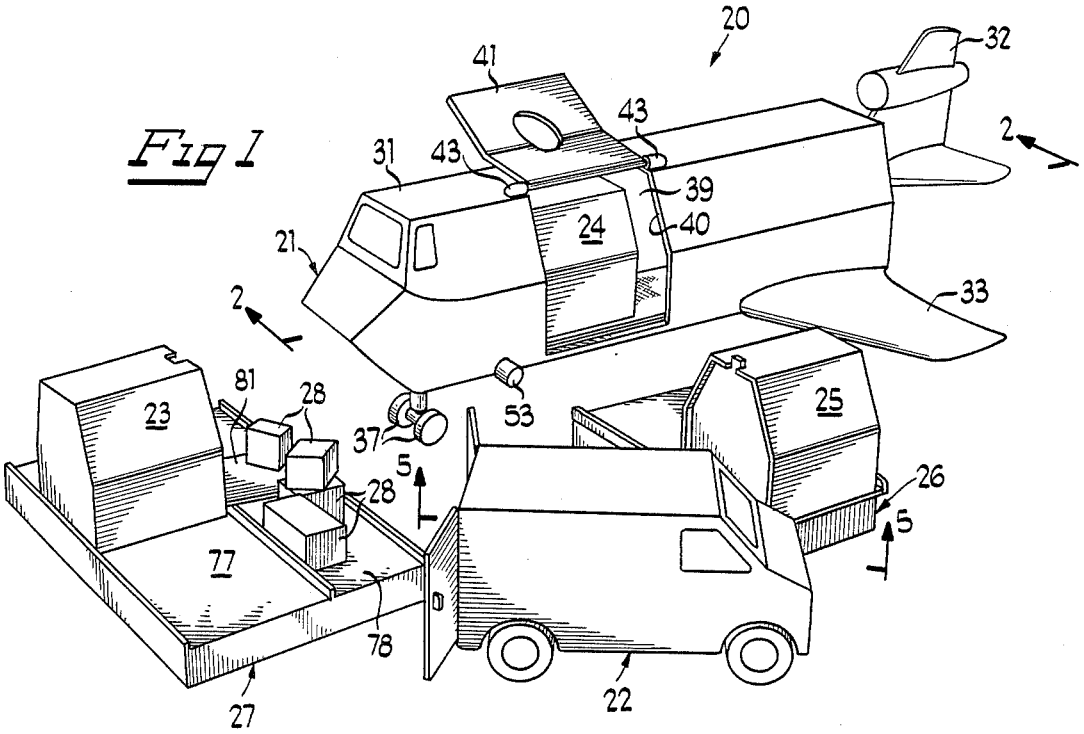
FIG. 1 is a perspective view of an embodiment of the present invention.
Figure 2:
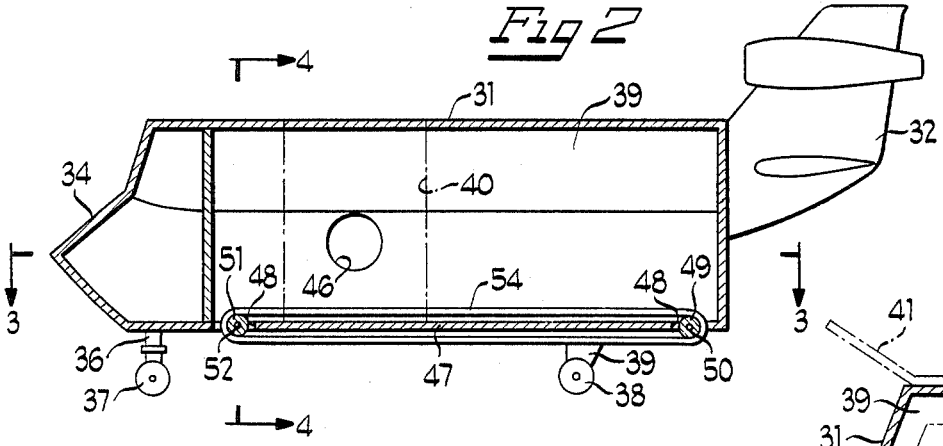
FIG. 2 is a sectional view taken generally along the line 2—2 of FIG. 1.

Referring now to the drawing in which like parts are designated by like reference characters throughout the several views, there is shown in FIG. 1 a playset 20 that includes an airplane 21, a delivery van 22, cargo containers 23, 24, and 25, cargo transporter 26, dock 27, and packages 28 of various sizes.

Airplane 21 has a body or fuselage 31 of a generally hollow hexagonal shape in cross section. Attached to the fuselage are a tail assembly 32 and wings 33. The front of the fuselage 31 opposite the tail assembly 32 converges to a forward cockpit and nose assembly 34. Disposed beneath the forward section 34 is a front landing gear 36 carrying a pair of spaced apart rotatable wheels 37. A single rotatable wheel 38 depends downwardly on a strut 39 from each of the wings 33. Thus, the airplane 21 is supported for rolling movement along a playing surface on the wheels 37 and 38.

Fuselage 31 defines a substantially enclosed cargo receiving area 39 with an opening 40 adjacent the fore end. An openable hatch 41 is provided for access to the interior cargo area 39. Hatch 41 is hingedly mounted along the top edge by means of pins 42 received in bosses 43 that may be secured to or formed an integral part of the fuselage 31. Formed in the hatch 41 is a circular access porthole 45 of a size suitable for a child to safely insert a finger. A similar access porthole 46 is formed in the fuselage 31 opposite the porthole 45.

Figure 3:
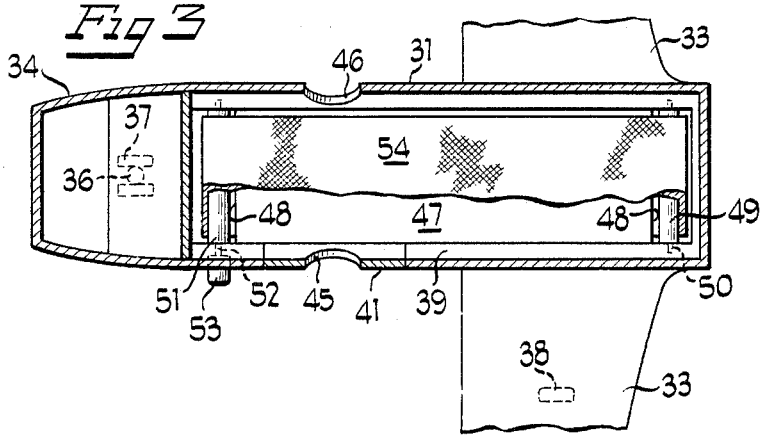
FIG. 3 is a fragmentary sectional view taken generally along the line 3—3 of FIG. 2.
Figure 5:
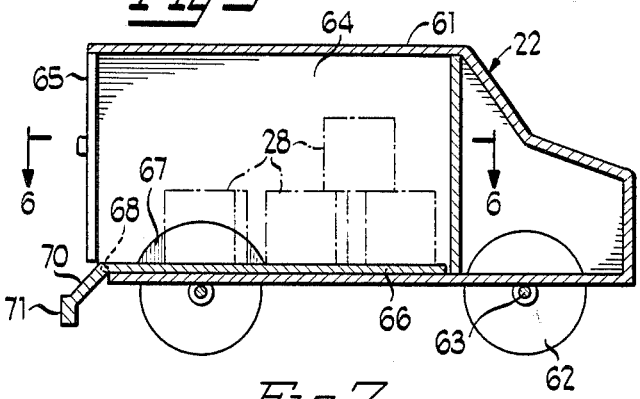
FIG. 5 is a sectional view taken generally along the line 5—5 of FIG. 1.
Figure 6:
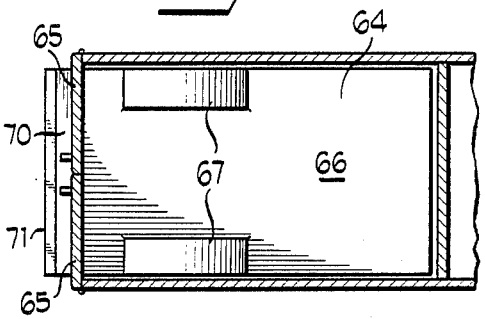
FIG. 6 is a fragmentary sectional view taken generally along the line 6—6 of FIG. 5.

Adjacent the fore and aft ends of the bottom wall 47 of the fuselage there is a transverse rectangular slot 48. Roller 49 mounted on axle 50 is journaled for rotation between the sidewalls of the fuselage 31 in the aft slot. A similar roller 51 on a longer axle 52 is journaled for rotation between the side walls in the fore slot 48. One end of the axle 52 extends through the side of the fuselage and has a knob 53 secured for rotation with the axle and roller. Conveyor belt loop 54 is stretched over the spaced rollers 49 and 51 so as to be in frictional engagement with the rollers. Thus, turning the knob 53 will effect linear movement of the conveyor belt 54. As shown in FIGS. 1 and 3, clockwise rotation of the knob 53 will move the part of the conveyor belt 54 that is atop the floor or bottom wall 47 toward the rear or aft end of the fuselage while counterclockwise rotation will advance the upper part of the belt towards the front or fore end of the airplane.

Cargo area 39 in the fuselage 31 is sufficiently large, to receive the three containers 23, 24, and 25. The opening 40 is sufficiently large to receive each of the cargo containers 23, 24, and 25. Accordingly, when a cargo container, such as 24, is loaded into the cargo area 39 through the doorway 40, the container may be moved toward the rear of the fuselage by clockwise rotation of the knob 53. The bottom wall 47 and the top part of the conveyor belt 54 are spaced from the surface upon which the airplane 21 is resting at predetermined heights. While bottom wall 47 could be omitted, the conveyor belt 54 may sag too much without the underlying support for the containers provided by wall 47.

Figure 4:
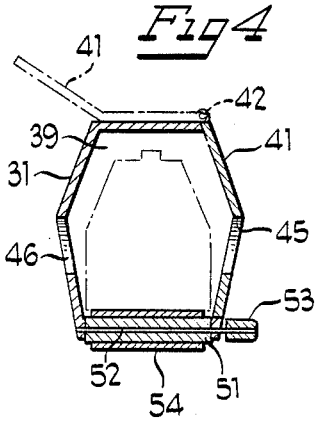
FIG. 4 is a sectional view taken generally along the line 4—4 of FIG. 2.

Porthole 46 facilitates unloading of the containers by permitting the child to insert a finger through the port to push the cargo container off the conveyor and out of the opening 40. Opposed porthole 45 facilitates grasping the hatch 41 with a finger to lift the hatch up to the open position shown in FIG. 1 and also illustrated in phantom in FIG. 4.

Delivery van 22 has a body 61 the outer appearance of which resembles a van or small truck and is supported for rotation on wheels 62 mounted on axles 63. A substantial part of the body 61 comprises a generally open package area 64 into which a number of the packages 28 may be inserted. At the back end of the van a pair of hinged doors 65 each hinged along the outer side open to provide access to the interior of the package area. The floor 66 of the cargo area is mounted for pivotal movement about a fulcrum axis parallel to that of the wheel axles 63 and disposed adjacent the rearward edge of the package area 64.

Rear wheel wells 67 on either side of the floor 66 accommodate the portion of the wheels 62 that extend up into the package area. Sidewardly extending pins 68 each of which is journaled in a respective side wall of the body 61 form the fulcrum axis. Tilt-dump floor 66 includes a rearwardly and downwardly projecting actuator 70 which extends out beyond the pins 68 and terminates in a rear bumper 71 disposed approximately halfway between the bottom of the body 61 and the surface upon which the van 22 is supported by the wheels 62. Thus, the floor and actuator assemble forms a first class lever with the floor 66 being the load arm, the actuator 70 being the effort arm, and the pins 68 being the fulcrum.

Figure 7:
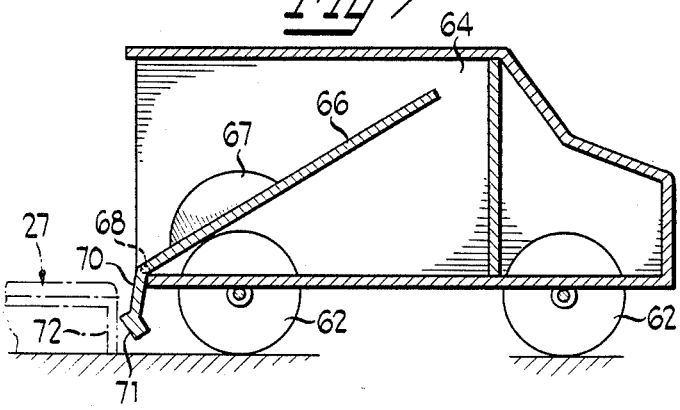
FIG. 7 is a sectional view similar that of FIG. 5 but showing the tilt-dump floor in operation.
Figure 8:
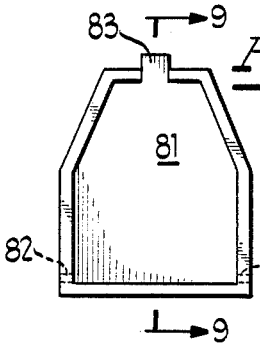
FIG. 8 is an end elevational view of one of the cargo containers.

Dock 27 has a generally horizontal platform spaced from the playing surface by depending peripheral skirt walls 72, a height substantially less than the height of the tilt-dump floor 66 from the same playing surface and also substantially less than the height of the top of the conveyor belt 54 from the same playing surface. Conveniently, the top platform surface of the dock 27 has short upwardly extendind retaining walls 74 along opposed sides and is divided by an inner upstanding wall 75 into a cargo container area 77 and a package area 78. The ends of the dock 27 perpendicular to the sides having the retaining walls 74 are left open to facilitate the loading and unloading of packages and cargo containers. As illustrated in FIG. 7 when the delivery van 22 is backed up toward the loading dock 27 so that the bumper 71 impacts one of the skirt walls 72 the floor 66 will tilt up at an angle from the horizontal position causing the package 28 contained within the van to be dumped out on to the dock 27.

Figure 9:
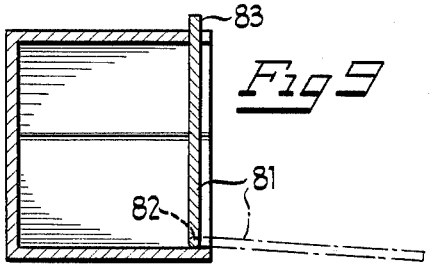
FIG. 9 is a section view taken generally along the line 9—9 of FIG. 8.
Figure 10:
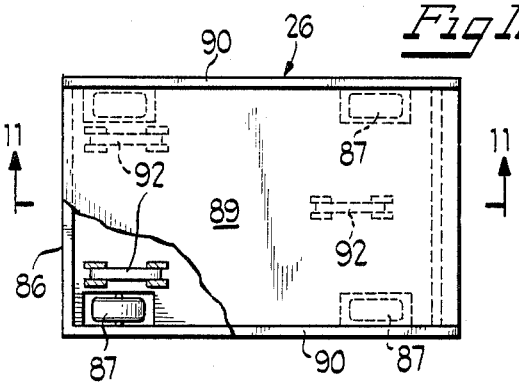
FIG. 10 is a top plan view, partially broken away, of the cargo transporter.

Each of the cargo containers 23–25 has one side 81 that is hinged on pins 82 at the bottom so that the side may be dropped down as illustrated in phantom in FIG. 9 to open the cargo container. A tab 83 at the top of the openable side 81 facilitates manipulation of the side for opening and closing of the cargo container. The interior of each of the cargo containers is sufficiently large to accept a number of the packages 28. Thus, after the child backs the delivery van 22 up to the dock 27 and dumps out a number of the packages 28 onto the package receiving part 78 of the dock, a cargo container, such as 23, may be positioned in the container area 77 and, after opening door 81, a number of packages 28 may be placed inside the container.

Cargo transport 26 provides further play in the transfer of the cargo containers from the dock 27 to the airplane 21. Transport 26 has an undercarriage 86 supported for rotation on the playing surface by four wheels 87 each of which is mounted on the undercarriage 86 for rotation. A generally planar rectangular cargo container receiving deck 89 is conveniently provided with upstanding short retaining walls 90 on two opposed sides with the perpendicular edges remaining clear to facilitate the sliding of cargo containers onto and off the deck. Spaced links 92 are connected at one end to the underside of the deck 89 and at the opposite end to the undercarriage 86 by means of pins 93 to permit the links 92 to pivot relative to the beams formed by the undercarriage and the deck. Thus, the pivoting linkage formed by the undercarriage 86 and deck 89 and the three links 92 permit the deck 89 to be extended upwardly and outwardly from the position shown in FIG. 11 to that shown in FIG. 12.

Figure 11:
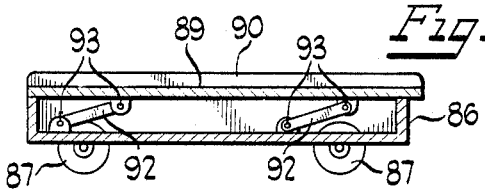
FIG. 11 is a sectional view taken generally along the line 11—11 of FIG. 10.
Figure 12:
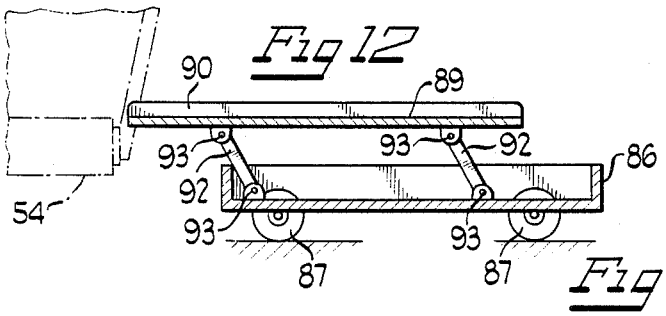
FIG. 12 is a sectional view of the transporter showing it in a raised position.
Figure 13:
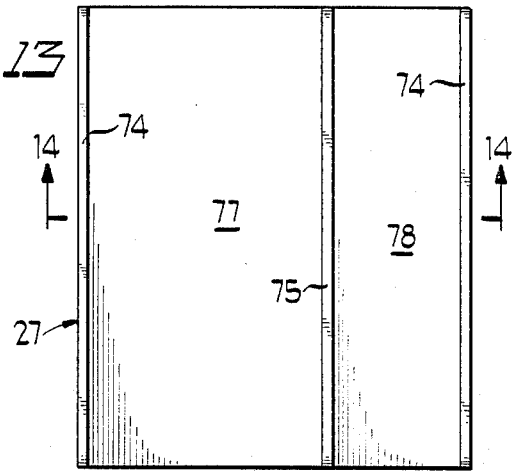
FIG. 13 is a top plan view of the dock.
Figure 14:
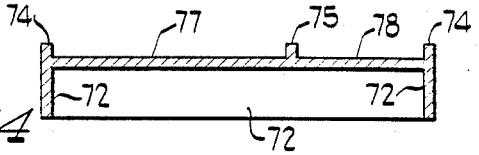
FIG. 14 is a sectional view taken generally along the line 14—14 of FIG. 13.

Transport 26 is constructed so that when the deck is resting upon the undercarriage in the lower position as shown in FIG. 11 the top surface of the deck 89 is at a height substantially equal to the platform of the cargo container area 77 on the dock 27. Hence, a cargo container may be slid off the open end of the dock onto the deck 89 and the transport wheeled over to the airplane 21. In the raised and extended position, the deck 89 is at a height generally equal to or slightly above that of the top of the conveyor 54 to permit cargo containers to be pushed off the deck onto the conveyor belt 54 in the airplane.

While a particular embodiment of the present invention has been shown and described, it will be apparent to those skilled in the art that changes and modifications may be made without departing from the true spirit and scope of the present invention. It is intended in the following claims to cover all such changes and modifications.

What is claimed as new and desired to be secured by Letters Patent is:

1. A playset comprising:

a plurality of cargo containers;

an airplane having a substantially enclosed cargo area for receiving the cargo containers;

said airplane including access means to the cargo area;

conveyor means mounted within said cargo area for transporting the cargo containers from adjacent the access means to other portions of the cargo area;

the access means including an opening into said cargo area and a hatch hingedly mounted to said airplane for closing the opening;

a first porthole in the hatch of a size for the insertion of a human digit; and a second porthole in the airplane of a size for the insertion of a human digit into the cargo area at a location opposite the first porthole.

2. The playset of claim 1 in which:

the airplane is supportable on a playing surface;

the cargo area has a bottom spaced a predetermined height from the playing surface; and the cargo area has a fore end and an aft end.

3. The playset of claim 2 in which:

a pair of spaced, substantially parallel, rollers are journaled for rotation adjacent the bottom of the cargo area;

one of the rollers is adjacent the fore end and the other is adjacent the aft end of the cargo area;

a conveyor belt loop extends over the rollers such that rotation of one of the rollers will effect transverse movement of the conveyor belt; and an actuator for operating one of the rollers is manipulable from outside of the airplane.

4. The playset of claim 3 in which:

the rollers are each mounted on axles;

one end of one of the axles extends through to the outside of the airplane; and the actuator comprises a knob secured to the one axle for rotation with the axle and the roller.

5. The playset of claim 2 including:

a dock supportable on the playing surface with a platform for the cargo containers; and a transporter for moving the cargo containers from the dock onto the airplane.

6. The playset of claim 5 in which:

the platform is at a different height from the playing surface than the predetermined height; and the transporter includes a deck movable between the different heights of the dock platform and the bottom of the airplane cargo area.

7. The playset of claim 6 in which the transporter includes a carriage on which wheels are mounted for rotation and the deck is pivotally connected to the carriage.

8. The playset of claim 7 in which the pivotal connection between the deck and the carriage comprises a number of spaced links with one end of each link pivotally connected to the carriage and the other end of each link pivotally connected to the deck.

9. The playset of claim 1 including:

a plurality of packages; and a number of said packages being insertable within each said container.

10. The playset of claim 9 including a wheeled vehicle with a package area for receiving a number of the packages.

11. The playset of claim 10 in which:

the wheeled vehicle has a front and a rear;

the package area is disposed toward the rear; and an opening to the package area is provided at the rear.

12. The playset of claim 11 including a door hingedly mounted adjacent the rear of the wheeled vehicle.

13. The playset of claim 12 in which the door is hinged for pivoting about a substantially vertical axis.

14. The playset of claim 11 in which the package area of the wheeled vehicle has a floor mounted for tilting about a substantially horizontal axis adjacent the rear opening.

15. The playset of claim 14 in which said floor includes an actuator extending outwardly from the wheeled vehicle in a relationship with said horizontal axis for effecting tilting of the floor from a generally horizontal plane to a plane inclined downwardly from the front to the rear of the vehicle.

16. A playset comprising:

a plurality of cargo containers;

an airplane having a substantially enclosed cargo area for receiving the cargo containers;

said airplane including access means to the cargo area;

conveyor means mounted within said cargo area for transporting the cargo containers from adjacent the access means to other portions of the cargo area;

a plurality of packages;

a number of said packages being insertable within each said container;

a wheeled vehicle with a package area for receiving a number of the packages;

the wheeled vehicle having a front and a rear;

the package area being disposed toward the rear;

an opening to the package area being provided at the rear;

the package area of the wheeled vehicle having a floor mounted for tilting about a substantially horizontal axis adjacent the rear opening;

said floor including an actuator extending outwardly from the wheeled vehicle in a relationship with said horizontal axis for effecting tilting of the floor from a generally horizontal plane to a plane inclined downwardly from the front to the rear of the vehicle;

a dock for the off-loading of the packages from the wheeled vehicle is included;

the wheeled vehicle and the dock being supportable upon a playing surface;

the dock having a package-receiving platform spaced a fixed height from the playing surface;

at least one skirt wall extending downwardly from the platform toward the playing surface;

the floor of the wheeled vehicle in its generally horizontal position being at a greater height from the playing surface than the fixed height of the platform from the same playing surface; and engagement of the actuator with the wall effecting tilting of the floor.

17. A playset comprising:

a plurality of cargo containers;

an airplane having a substantially enclosed cargo area for receiving the cargo containers;

said airplane including access means to the cargo area;

conveyor means mounted within said cargo area for transporting the cargo containers from adjacent the access means to other portions of the cargo area;

a plurality of packages;

a number of said packages being insertable within each said container;

a wheeled vehicle with a package area for receiving a number of the packages;

the wheeled vehicle having a front and a rear;

the package area being disposed toward the rear;

an opening to the package area being provided at the rear;

the package area of the wheeled vehicle having a floor mounted for tilting about a substantially horizontal axis adjacent the rear opening;

said floor including an actuator extending outwardly from the wheeled vehicle in a relationship with said horizontal axis for effecting tilting of the floor from a generally horizontal plane to a plane inclined downwardly from the front to the rear of the vehicle; and the floor and the actuator forming a first class lever with the generally horizontal axis as the fulcrum, the actuator as the effort arm, and the floor as the load arm.

* * * * *